US005497523A

United States Patent [19]

Tarnoff

[11] Patent Number: 5,497,523

[45] Date of Patent: Mar. 12, 1996

[54] AUTOMATIC GOLF SPIKE REPLACER

[75] Inventor: David Tarnoff, Bainbridge Island, Wash.

[73] Assignee: The Golf Zone, Inc., Bainbridge Island, Wash.

[21] Appl. No.: 497,531

[22] Filed: Jun. 30, 1995

Related U.S. Application Data

[63] Continuation of Ser. No. 977,193, Nov. 16, 1992, abandoned.

[51] Int. Cl.[6] ..... B25B 13/00

[52] U.S. Cl. ..... 7/138; 81/461

[58] Field of Search ..... 7/138; 81/176.15, 81/461

[56] References Cited

U.S. PATENT DOCUMENTS

| | | | |
|---|---|---|---|
| 2,770,991 | 11/1956 | Myers | 7/138 X |
| 3,243,831 | 4/1966 | Wigley | 7/138 X |
| 3,797,055 | 3/1974 | Greene | 7/138 |
| 5,048,138 | 9/1991 | Everroad | 7/138 |
| 5,272,943 | 12/1993 | Edwards | 81/461 |

*Primary Examiner*—James G. Smith

*Attorney, Agent, or Firm*—Christensen, O'Connor, Johnson & Kindness

[57] ABSTRACT

An automatic golf spike replacement tool having a non circular drive shaft, a sharply pointed tip on the drive end of the shaft and a golf spike driver on the other end of the shaft. The pointed tip is used for cleaning debris from the tool holes of used golf shoe spikes prior to removal. The automatic golf spike replacer is then used in conjunction with a power driver for removal and replacement of the golf shoe spikes.

4 Claims, 1 Drawing Sheet

AUTOMATIC GOLF SPIKE REPLACER

CROSS REFERENCE TO RELATED APPLICATION

The present invention is a continuation of U.S. patent application Ser. No. 07/977,193 filed Nov. 16, 1992 now abandoned.

TECHNICAL FIELD OF THE INVENTION

The present invention relates to golfing apparatus, and more particularly to devices for removing and replacing the spikes of golf shoes.

SUMMARY OF THE INVENTION

The automatic golf spike replacer of the present invention is a tool having a non circular drive shaft, a sharply pointed tip on the drive end of the shaft and a golf spike driver on the other end of the shaft. The pointed tip is used for cleaning debris from the tool of used golf shoe spikes prior to removal. The automatic golf spike replacer is then used in conjunction with a power driver for removal and replacement of the golf shoe spikes.

The purpose of the automatic golf spike replacer is to automatically take out and replace spikes from golf shoes easily and efficiently without stress and strain to hands and wrists.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
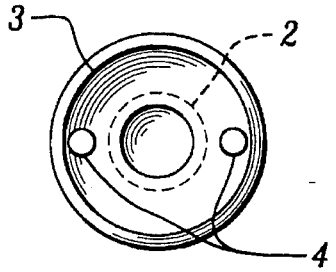
FIG. 1 is a bottom elevation view of the golf spike driver end of the golf spike replacer of the present invention.
Figure 2:
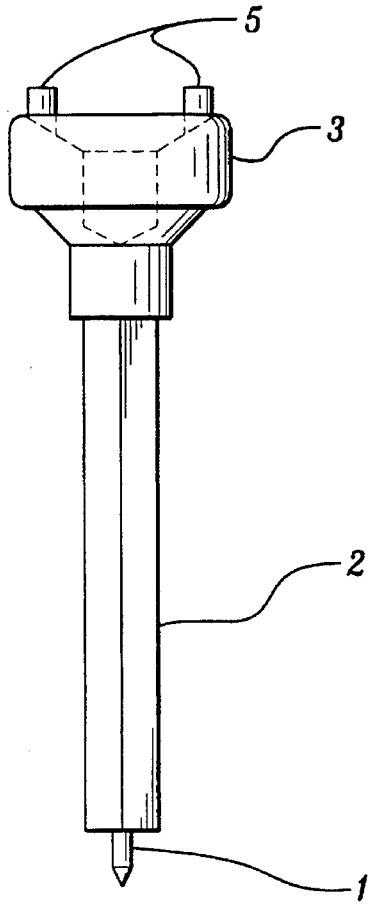
FIG. 2 is a side elevation view of the golf spike replacer of FIG. 1.
Figure 3:
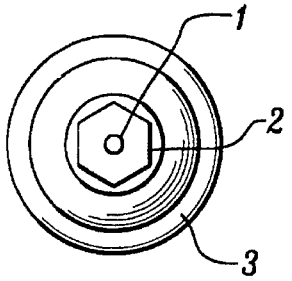
FIG. 3 is a top elevation view of the cleaning point end of the golf spike replacer of FIG. 1.

The automatic golf spike replacer of the present invention is a tool having a non circular shaft 2, a sharply pointed tip 1 on the drive end of the shaft 2, (illustrated in FIGS. 1, 2 and 3) and a golf spike driver 3 on the other end of the shaft. The shaft 2 is preferably 2 inches long, as measured from the bottom of the tip 1 to the angled base of the golf spike driver 3. This shaft 2 is preferably a ¼ inch hexagonal shaft (measured from flat to flat) and fits into a power driver. The sharply pointed tip 1 on the drive end of the shaft 2 preferably has a 1/16 inch diameter and 3/16 inch length, and is centrally aligned on the longitudinal axis of the shaft 2.

This pointed tip 1 is used to clean out the mud, dirt, grit and debris from the tool holes formed in the mounting base of conventional used golf spikes. This assures a good seating of the golf spike driver 3 into the used golf spike. After the used golf spike tool holes are clean the drive end of the shaft 2 is inserted into the power driver and the automatic golf spike replacer is used to remove and replace the spikes. As a measure of efficiency, to remove a set of 22 used golf spikes and replace with new spikes takes approximately 10 minutes when the automatic golf spike replacer of the present invention is used in conjunction with a power driver. Although the automatic golf spike replacer is specifically designed to be used with a power driver, it can also be used with other drivers such as a drill.

The cap of the golf spike driver 3 also includes a central recess formed in the opposite, distal end face of the cap. This recess receives a golf spike when the tool is engaged with the base of a spike that is being installed or removed. The distal end face of the cap also includes two holes 4 that each fixedly receive a longitudinally oriented pin 5 on opposite diametrically opposed sides of the recess. The pins 5 extend a distance longitudinally from the distal end of the cap that is predetermined to engage the tool holes formed in a conventional golf spike base.

The automatic golf spike replacer can be constructed from any material having the structural integrity to withstand the stresses involved such as structural steel, stainless steel, high impact plastic or combinations thereof.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A tool for use in powered removal of athletic shoe spikes, each spike having a base defining a plurality of tool engaging holes, the tool comprising:

an elongate shaft having a drive end and a tool end, wherein the drive end has a non-circular cross-sectional profile for driven engagement with a power driver;

a tool head secured axially to the tool end of the shaft, the tool head including a plurality of longitudinally projecting pins for engaging the tool engaging holes of the base of an athletic shoe spike and defining a recess formed between the plurality of pins for receiving the spike; and a pointed cleaning tip projecting longitudinally from the drive end of the shaft and dimensioned for use in cleaning debris from the tool engaging holes of the base of an athletic shoe spike.

2. The tool of claim 1, wherein the cleaning tip is disposed on a longitudinal axis of the shaft.

3. The tool of claim 1, wherein the tool end of the shaft has a hexagonal cross sectional profile.

4. A tool for use in powered removal of athletic shoe spikes, each spike having a base defining tool engaging apertures, the tool comprising an elongate shaft having a non-circular cross-sectional profile for driven engagement with a power driver, the shaft having a drive end defining a driver head including tool engaging projections for rotary drive engagement with the at least one tool engaging apertures of the spike, wherein the shaft further carries a narrow elongate cleaning projection for use in cleaning debris from the tool engaging aperture of the spike.

* * * * *